US011186057B2

(12) United States Patent
Huang et al.

(10) Patent No.: US 11,186,057 B2
(45) Date of Patent: Nov. 30, 2021

(54) PRESS MACHINE AND PRESS MACHINE EXECUTION SYSTEM

(71) Applicant: HEFEI UNIVERSITY OF TECHNOLOGY, Hefei (CN)

(72) Inventors: Haihong Huang, Hefei (CN); Lei Li, Hefei (CN); Zhicheng Cao, Hefei (CN); Zhifeng Liu, Hefei (CN)

(73) Assignee: HEFEI UNIVERSITY OF TECHNOLOGY, Hefei (CN)

( * ) Notice: Subject to any disclaimer, the term of this patent is extended or adjusted under 35 U.S.C. 154(b) by 233 days.

(21) Appl. No.: 16/565,179

(22) Filed: Sep. 9, 2019

(65) Prior Publication Data

US 2020/0001563 A1 Jan. 2, 2020

Related U.S. Application Data

(63) Continuation of application No. PCT/CN2018/098915, filed on Aug. 6, 2018.

(30) Foreign Application Priority Data

Aug. 30, 2017 (CN) ..... 201710765672.5
Aug. 30, 2017 (CN) ..... 201710765683.3

(51) Int. Cl.
*B30B 15/10* (2006.01)
*B30B 15/14* (2006.01)
(Continued)

(52) U.S. Cl.
CPC ..... *B30B 15/166* (2013.01); *B30B 1/183* (2013.01); *B30B 1/23* (2013.01); *B30B 1/32* (2013.01);
(Continued)

(58) Field of Classification Search
CPC ..... B30B 1/18; B30B 1/181; B30B 1/183; B30B 1/186; B30B 1/23; B30B 1/24;
(Continued)

(56) References Cited

U.S. PATENT DOCUMENTS 3,250,210 A * 5/1966 Rickard ..... A23N 1/003 100/353
3,640,210 A * 2/1972 Georg ..... B30B 1/23 100/346
(Continued)

FOREIGN PATENT DOCUMENTS

CN 201258955 Y 6/2009
CN 201707201 U 1/2011
(Continued)

OTHER PUBLICATIONS

The International Search Report of corresponding international application No. PCT/CN2018/098915, dated Nov. 13, 2018.
(Continued)

*Primary Examiner* — Jimmy T Nguyen
(74) *Attorney, Agent, or Firm* — J.C. Patents

(57) ABSTRACT

A press machine is provided. Two vertical hydraulic cylinders are arranged on an upper beam plate of a press machine body, and the two hydraulic cylinders correspond to workbenches at corresponding positions in a one-to-one correspondence, constituting left and right working units, and a common mechanical drive unit and a common hydraulic drive unit are set for the left and right working units. The mechanical driving unit is composed of a driving motor through an electromagnetic clutch, an electromagnetic brake and lead screw nut driving mechanism driven by a gear pair. According to the load profiles during the working process of hydraulic press machine, the mechanical driving unit or the hydraulic driving unit are selected to provide energy for the two working units. A control method for the press machine,
(Continued)

a press machine execution system and a control method for the press machine execution system are further involved.

3 Claims, 6 Drawing Sheets

(51) Int. Cl.
*B30B 15/16* (2006.01)
*B30B 1/23* (2006.01)
*B30B 7/00* (2006.01)
*B30B 1/18* (2006.01)
*B30B 1/32* (2006.01)

(52) U.S. Cl.
CPC ..... *B30B 7/00* (2013.01); *B30B 15/10* (2013.01); *B30B 15/142* (2013.01)

(58) Field of Classification Search
CPC .. B30B 1/32; B30B 1/34; B30B 15/14; B30B 15/16; B30B 15/166; B30B 15/10; B30B 15/142; B30B 7/00; B30B 7/04; F15B 15/065; F15B 15/068; F15B 2015/1495
USPC ..... 100/237, 270
See application file for complete search history.

(56) References Cited

U.S. PATENT DOCUMENTS 3,884,744 A * 5/1975 Ranocha ..... B29C 66/8322 156/351
4,282,739 A * 8/1981 Hallenbeck ..... B30B 1/24 100/270
6,647,870 B2 * 11/2003 Kohno ..... B30B 1/186 100/269.14
2010/0307349 A1 * 12/2010 Martin ..... B30B 15/16 100/35
2016/0311217 A1 * 10/2016 Tseng ..... B30B 1/23

FOREIGN PATENT DOCUMENTS

| | | | |
|---|---|---|---|
| CN | 102582098 | A | 7/2012 |
| CN | 202861370 | U | 4/2013 |
| CN | 103991237 | A | 8/2014 |
| CN | 204160754 | U | 2/2015 |
| CN | 104943216 | A | 9/2015 |
| CN | 205416432 | U | 8/2016 |
| CN | 106015135 | A | 10/2016 |
| CN | 106553370 | A | 4/2017 |
| CN | 107538776 | A | 1/2018 |
| CN | 107538788 | A | 1/2018 |
| EP | 2 452 762 | B1 | 1/2013 |
| KR | 2008-0000384 | A | 1/2008 |

OTHER PUBLICATIONS

The Chinese First Examination Report and Search Report of corresponding Chinese application No. 201710765672.5, dated Oct. 8, 2018.
The Chinese First Examination Report and Search Report of corresponding Chinese application No. 201710765683.3, dated Oct. 9, 2018.
First search report of CN2017107656725.
First search report of CN2017107656833.
Supplementary search report of CN2017107656725.
Supplementary search report of CN2017107656833.

* cited by examiner

PRESS MACHINE AND PRESS MACHINE EXECUTION SYSTEM

CROSS-REFERENCE TO RELATED APPLICATIONS

This application is a continuation of International Application No. PCT/CN2018/098915, filed on Aug. 6, 2018, which claims priorities to Chinese Patent Application No. 2017107656833, filed on Aug. 30, 2017, and Chinese Patent Application No. 2017107656725, filed on Aug. 30, 2017. All of the aforementioned patent applications are hereby incorporated by reference in their entireties.

TECHNICAL FIELD

The present disclosure relates to a press machine and its execution system, in particular, to an electro-hydraulic hybrid press machine including two actuators and a control method thereof, which are used for maintaining high efficiency of the driving system, reducing energy loss in a working process of the press machine, reducing material consumption and component usage during the manufacturing process of the press machine, increasing the speed and accuracy of a moveable part of the actuators of the press machine and improving the working efficiency of the press machine.

BACKGROUND

Hydraulic press machine, as an important part of forming equipment, which has advantages of stable transmission, and simple control, has a wide range of applications. However, in the hydraulic machine, there are many energy conversion links, the efficiency of the energy use is low, and the mismatch between load profiles and drive, and potential energy waste occurs, the noise and vibration are large, the movement speed of the actuator is slow and unstable, and the motion precision is low. The aforementioned disadvantages affect the working efficiency, precision, and energy consumption control of the press machine.

Recycling the potential energy in the falling process of the moveable part of the actuators has a certain effect on energy saving, but there are two processes including storage and reuse in the process of energy recycling, which increases the number of energy conversion links. In addition, the complexity of the conversion process reduces the efficiency of energy utilization and affects the controllability of the system.

On the other hand, forming a part often needs to go through multiple processes. It is common to use multiple press machines in the production of the existing forming workshop. Therefore, it has become an urgent problem to be solved that how to reduce material consumption and component use, improve production efficiency, and reduce energy consumption in the use process while meeting the performance requirements of the press machine.

The mechanical press machine adopts the rigid connections and the motor driving mode, which makes the flexibility of the system poor and it is difficult to generate a large working pressure. At the same time, under the same pressing requirement, the motor power of the mechanical press machine is larger than that of the hydraulic press machine, so that the energy consumption of the mechanical press machine is higher.

SUMMARY

In order to avoid the deficiencies of the prior art, the present disclosure provides an electro-hydraulic hybrid press machine and its control method, which combines the advantages of the hydraulic transmission and mechanical transmission, improves the working efficiency and operation accuracy of the press machine, reduces the energy loss in the working process of the press machine, and reduces the material consumption and the component use in the manufacturing process of the press machine.

The present disclosure adopts the following technical solutions to solve the aforementioned problems.

The structural features of the electro-hydraulic hybrid press machine are that: two vertical hydraulic cylinders are arranged in one press machine body, and the two hydraulic cylinders correspond a one-to-one correspondence to workbenches at corresponding positions, constituting left and right working units; a common mechanical drive unit and a common hydraulic drive unit are set for the left and right working units; the mechanical drive unit and moveable parts of two hydraulic cylinders form a linkage structure outside the cylinder body through a mechanical transmission structure, and the two hydraulic cylinders are electrically driven and reversely linked using the mechanical drive unit.

The structural features of the electro-hydraulic hybrid press machine of the present disclosure are also listed as follows.

The two hydraulic cylinders are the first hydraulic cylinder and the second hydraulic cylinder respectively, and are arranged symmetrically on the upper beam plate of the press machine body in a left-right direction, the first workbench and the second workbench are arranged in a one-to-one correspondence directly under the first hydraulic cylinder and the second hydraulic cylinder, the first hydraulic cylinder and the first workbench constitute the left working unit, and the second hydraulic cylinder and the second workbench constitute the right working unit.

The mechanical drive unit has a structural form as follows: a driving motor is provided as the power source, an electromagnetic clutch is arranged on the output shaft of the driving motor, the electromagnetic clutch is connected to a gear shaft, and a transmission gear is arranged on the gear shaft, and an electromagnetic brake is arranged between the electromagnetic clutch and the transmission gear; meshing gears are symmetrically arranged on left and right sides of the transmission gear, gear shafts of the two meshing gears are arranged in a one-to-one correspondence with the first lead screw and the second lead screw which are arranged vertically, and the first nut seat and the second nut seat constitute screw-nut pairs respectively with the first lead screw and the second lead screw in a one-to-one correspondence, the first nut seat and the second nut seat move reversely in a vertical direction by rotating the transmission gear; the first nut seat and the second nut seat constitute linkage structures outside the cylinder body respectively with the moveable part of the first hydraulic cylinder and the second hydraulic cylinder in a one-to-one correspondence.

The hydraulic drive unit has a structural form as follows: a hydraulic pump is driven by a power motor, the oil outlet of the hydraulic pump is connected to a port P of a three-position four-way electromagnetic directional valve through the oil inlet of the main pipe, a port A and a port B of the three-position four-way electromagnetic directional valve are connected to the upper chamber port of the first hydraulic cylinder and the upper chamber port of the second hydraulic cylinder through the first oil inlet branch pipe and the second oil inlet branch pipe in a one-to-one correspondence, a port T of the three-position four-way electromagnetic directional valve is connected to the oil tank through an oil returning main pipe, the lower chamber port of the first hydraulic cylinder and the lower chamber port of the second hydraulic cylinder are respectively connected to the oil tank through the oil returning main pipe, the branch of the oil inlet of the main pipe is connected to an overflow valve.

In the three-position four-way electromagnetic directional valve, the configuration in the middle position is H-type, where the port P, the port A, the port T, and the port B are all communicated; at the left position, the port P communicates with the port A and the port T communicates with the port B; and at the right position, the port P communicates with the port B and the port T communicates with the port A.

The control method for the electro-hydraulic hybrid press machine of the present disclosure proceeds as follows.

Step 1, synchronously performing fast falling of the left working unit and fast rising of the right working unit.

The power motor is started to operate a hydraulic system, the three-position four-way electromagnetic directional valve is set at the middle position, the hydraulic system is unloaded, the output shaft of the driving motor is set to rotate counterclockwise, the electromagnetic brake is released from braking, and the electromagnetic clutch is turned on, the driving motor drives the transmission gear to rotate counterclockwise, and through the transmission of a meshing gear and a lead screw-nut pair, the first nut seat drives a moveable part of the first hydraulic cylinder to fall rapidly, and at the same time, the second nut seat drives a moveable part of the second hydraulic cylinder to rise rapidly, which realizes the synchronization of fast falling of the left working unit and fast rising of the right working unit.

Step 2, synchronously performing working process of the left work unit and slow rising of the right work unit.

When fast falling of the left working unit is completed, the three-position four-way electromagnetic directional valve is controlled to switch to the left position, and a high-pressure hydraulic oil is supplied to the upper chamber port of the first hydraulic cylinder through the first oil inlet branch pipe, so as to control a rotational speed of the driving motor, the mechanical drive unit and the hydraulic drive unit jointly complete working process of the left work unit, and synchronously realize slow rising of the right work unit.

Step 3, pressure maintaining of the left working unit.

When working process of the left working unit is completed, the electromagnetic clutch is disconnected, and the driving motor is controlled to achieve clockwise idling, so that the driving motor reaches a stable rotational speed when pressure maintaining of the left working unit is completed, the pressure maintaining of the left working unit is completed by the hydraulic drive unit, the hydraulic oil leaking through the piston of the first hydraulic cylinder flows back to the oil tank through lower chamber port of the first hydraulic cylinder.

Step 4, synchronously performing fast falling of the right working unit and fast rising of the left working unit.

When pressure maintaining of the left working unit is completed, the three-position four-way electromagnetic directional valve is controlled to switch to the middle position, the hydraulic system is unloaded, the electromagnetic clutch is turned on, and the driving motor drives the transmission gear to rotate clockwise, and through the transmission of the meshing gear and the lead screw-nut pair, the second nut seat drives the moveable part of the second hydraulic cylinder to fall rapidly, and the first nut seat drives the moveable part of the first hydraulic cylinder to rise rapidly, which realizes synchronization of fast falling of the right working unit and fast rising of the left working unit.

Step 5, synchronously performing working process of the right work unit and slow rising of the left work unit.

When fast falling of the right working unit is completed, the three-position four-way electromagnetic directional valve is controlled to switch to the right position, and the high-pressure hydraulic oil is supplied to the upper chamber port of the second hydraulic cylinder through a second oil inlet branch pipe so as to control the rotational speed of the driving motor, the mechanical drive unit and the hydraulic drive unit jointly complete working process of the right work unit, and synchronously realize slow rising of the left work unit.

Step 6, pressure maintaining of the right working unit.

When working process of the right working unit is completed, the electromagnetic clutch is disconnected, and the driving motor is controlled to achieve counterclockwise idling, so that the driving motor reaches a stable rotational speed when pressure maintaining of the right working unit is completed, the pressure maintaining of the right working unit is completed by the hydraulic drive unit, the hydraulic oil leaking through the piston of the second hydraulic cylinder flows back to the oil tank through the lower chamber port of the second hydraulic cylinder.

The control method for the electro-hydraulic hybrid press machine of the present disclosure, which is characterized in the braking process, is implemented as follows.

When the moveable part of the first hydraulic cylinder falls to a set position, the oil entering the upper chamber port of the first hydraulic cylinder is cut off, the electromagnetic clutch is disconnected, and the electromagnetic brake is controlled to brake the transmission gear, and through the meshing gear and the lead screw-nut pair, the moveable part of the first hydraulic cylinder is braked at the set position by the first nut seat, and at the same time, the moveable part of the second hydraulic cylinder is also braked at the corresponding position.

When the moveable part of the second hydraulic cylinder falls to a set position, the oil entering the upper chamber port of the second hydraulic cylinder is cut off, the electromagnetic clutch is disconnected, and the electromagnetic brake is controlled to brake the transmission gear, and through the meshing gear and the lead screw-nut pair, the moveable part of the second hydraulic cylinder is braked at the set position by the second nut seat, and at the same time, the moveable part of the first hydraulic cylinder is also braked at the corresponding position.

The execution system of the mechanical-hydraulic hybrid double-station press machine of the present disclosure is characterized in that: two vertical hydraulic cylinders are arranged in one press machine body, and the two hydraulic cylinders correspond a one-to-one correspondence to workbenches at corresponding positions, constituting left and right working units; a common mechanical drive unit and a common hydraulic drive unit are set for the left and right working units; the mechanical drive unit and moveable parts of two hydraulic cylinders form a linkage structure outside a cylinder body through a mechanical transmission structure, and the two hydraulic cylinders are electrically driven and reversely linked using the mechanical drive unit.

The two hydraulic cylinders are a first hydraulic cylinder and a second hydraulic cylinder respectively, which are symmetrically fixed to the press machine body in a left-right direction and are in the same vertical plane, at the position between the first hydraulic cylinder and the second hydraulic cylinder, a gear rack transmission mechanism driven by an electric motor through the electromagnetic clutch and the electromagnetic brake is provided; the gear rack transmission mechanism consists of a sun gear and the first rack and the second rack which are respectively arranged on the left and right sides of the sun gear, the first rack and the second rack move synchronously in vertical and reverse direction by rotating the sun gear, the first rack and a moveable part outside the body of the first hydraulic cylinder constitute a linkage structure through the first link rod, and the second rack and a moveable part outside of the body of the second hydraulic cylinder constitute a linkage structure through the second link rod, thereby forming the mechanical drive unit.

The execution system of the mechanical-hydraulic hybrid double-station press machine of the present disclosure is also characterized in that: in the gear rack transmission mechanism, a gear shaft is supported by a bearing, the bearing is fixed to the press machine body by a bearing support bracket; the electric motor and the electromagnetic brake are respectively located at both ends of the gear shaft; the gear shaft is driven to rotate by rotating the electric motor, the gear shaft is braked using the electromagnetic brake; the electromagnetic clutch is installed on the gear shaft between the electric motor and the gear.

The execution system of the mechanical-hydraulic hybrid double-station press machine of the present disclosure is characterized in that fast falling is implemented as follows.

For the first hydraulic cylinder, the electromagnetic brake is kept in a disconnected state, the electromagnetic clutch is turned on, the electric motor is controlled to rotate counter-clockwise, the first rack moves vertically downward to move the moveable part of the first hydraulic cylinder downward, the low-pressure oil in the hydraulic system is controlled to enter the upper chamber of the first hydraulic cylinder from the oil port of the upper chamber of the first hydraulic cylinder, thereby achieving fast falling of the first hydraulic cylinder; meanwhile, the second rack moves vertically upward to move the moveable part of the second hydraulic cylinder upward, the hydraulic oil in the upper chamber of the second hydraulic cylinder enters the hydraulic system from the oil port of the upper chamber of the second hydraulic cylinder, thereby achieving fast rising of the second hydraulic cylinder.

For the second hydraulic cylinder, the electromagnetic brake is kept in a disconnected state, the electromagnetic clutch is turned on, the electric motor is controlled to rotate clockwise, and the second rack moves vertically downward to move the moveable part of the second hydraulic cylinder downward, the low-pressure oil in the hydraulic system is controlled to enter the upper chamber of the second hydraulic cylinder from the upper chamber port of the second hydraulic cylinder, thereby achieving fast falling of the second hydraulic cylinder; meanwhile, the first rack moves vertically upward to move the moveable part of the first hydraulic cylinder upward, and the hydraulic oil in the upper chamber of the first hydraulic cylinder enters the hydraulic system from the upper oil port of the first hydraulic cylinder, thereby achieving fast rising of the first hydraulic cylinder.

The feature of the control method of the execution system of the mechanical-hydraulic hybrid double-station press machine of the present disclosure is characterized in that the pressing is implemented as follows.

For the first hydraulic cylinder, when fast falling of the first hydraulic cylinder is completed, both the electromagnetic brake and the electromagnetic clutch are controlled to be disconnected, and the high-pressure oil in the hydraulic system is controlled to enter the upper chamber of the first hydraulic cylinder from the upper chamber port of the first hydraulic cylinder, the moveable part of the first hydraulic cylinder moves downward, and the high-pressure oil of the upper chamber of the first hydraulic cylinder leaking through the piston of the first hydraulic cylinder returns to the hydraulic system through the lower chamber port of the first hydraulic cylinder, thereby achieving the pressing of the first hydraulic cylinder; meanwhile, the first rack is driven to move downward to move the second rack upward by the gear, so that the moveable part of the second hydraulic cylinder moves upward by the moving of the second rack, the hydraulic oil in the upper chamber of the second hydraulic cylinder enters the hydraulic system from the upper chamber port of the second hydraulic cylinder, thereby achieving slow rising of the second hydraulic cylinder.

For the second hydraulic cylinder, when fast falling of the second hydraulic cylinder is completed, both the electromagnetic brake and the electromagnetic clutch are controlled to be disconnected, and the high-pressure oil in the hydraulic system is controlled to enter the upper chamber of the second hydraulic cylinder from the upper chamber port of the second hydraulic cylinder, the moveable part of the second hydraulic cylinder moves downward, and the high-pressure oil of the upper chamber of the second hydraulic cylinder leaking through the piston of the second hydraulic cylinder returns to the hydraulic system through the lower chamber port of the second hydraulic cylinder, thereby achieving the pressing of the second hydraulic cylinder; meanwhile, the second rack is driven to move downward, and the first rack moves upward by the gear, so that the moveable part of the first hydraulic cylinder moves upward by the moving of the first rack, the hydraulic oil in the upper chamber of the first hydraulic cylinder enters the hydraulic system from the upper chamber port of the first hydraulic cylinder, thereby achieving slow rising of the first hydraulic cylinder.

The feature of the control method of the execution system of the mechanical-hydraulic hybrid double-station press machine of the present disclosure is characterized in that the braking process is implemented as follows.

For the first hydraulic cylinder, when the moveable part of the first hydraulic cylinder falls to the set position, the oil inlet in the upper chamber of the first hydraulic cylinder is closed, and the electromagnetic brake is controlled to the braking state, so that the sun gear is braked by the electromagnetic brake, the moveable part of the first hydraulic cylinder is braked at the set position using the first rack, and meanwhile, the moveable part of the second hydraulic cylinder is braked at a corresponding position using the second rack.

For the second hydraulic cylinder, when the moveable part of the second hydraulic cylinder falls to the set position, the oil inlet in the upper chamber of the second hydraulic cylinder is closed, and the electromagnetic brake is controlled to the braking state, so that the sun gear is braked by the electromagnetic brake, the moveable part of the second hydraulic cylinder is braked at the set position by using the second rack, and meanwhile, the moveable part of the first hydraulic cylinder is braked at a corresponding position using the first rack.

Compared with the prior art, the beneficial effects of the present disclosure are listed as follows.

1. The electro-hydraulic hybrid press machine in the present disclosure realizes that the falling moveable parts of one hydraulic cylinder can directly push the moveable parts of the other hydraulic cylinder to rise by setting the two hydraulic cylinders and keeping the synchronous movement, so that the potential energy of the moveable parts is directly utilized.

2. The electro-hydraulic hybrid press machine in the present disclosure can achieve the same moving speed even when the effective areas of two hydraulic cylinders of the press machine are not equal, and can realize different output pressures of the two hydraulic cylinders by setting the two hydraulic cylinders and keeping synchronous movement, which expands the range of use of the press machine.

3. The electro-hydraulic hybrid press machine in the present disclosure is provided with a mechanical transmission device between two hydraulic cylinders, which can adjust the working beat of the press machine, control the positioning accuracy of the execution mechanism, and improve the working efficiency and accuracy of the press machine.

4. The electro-hydraulic hybrid press machine in the present disclosure reduces the use of hydraulic valve blocks and hydraulic pipes, reduces the energy loss of the press machine in the hydraulic pipes and improves the energy efficiency by setting a mechanical transmission device between two hydraulic cylinders.

5. The electro-hydraulic hybrid press machine in the present disclosure can work on two driving modes by setting the driving modes of the two drives, i.e., hydraulic and mechanical ones, to ensure the efficient operation of the driving system and reduce the energy loss in working process.

6. The electro-hydraulic hybrid press machine in the present disclosure sets two actuators in one press machine body by configuring two hydraulic cylinders, which simplifies the product handling process during processing, shortens the handling time, improves the working efficiency, and reduces the material consumption, parts use and floor area of each press machine on average.

Figure 1:
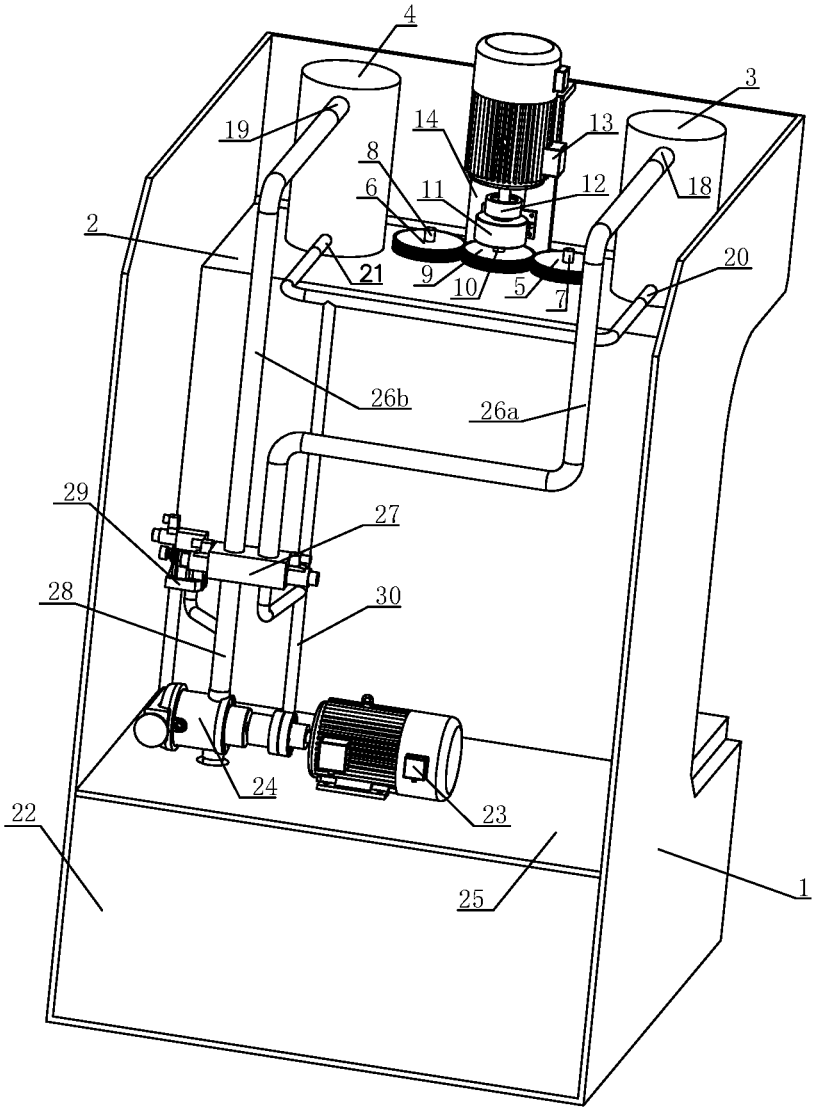
FIG. 1 is a schematic diagram showing the external structure of the electro-hydraulic hybrid press machine according to embodiment 1.
Figure 2:
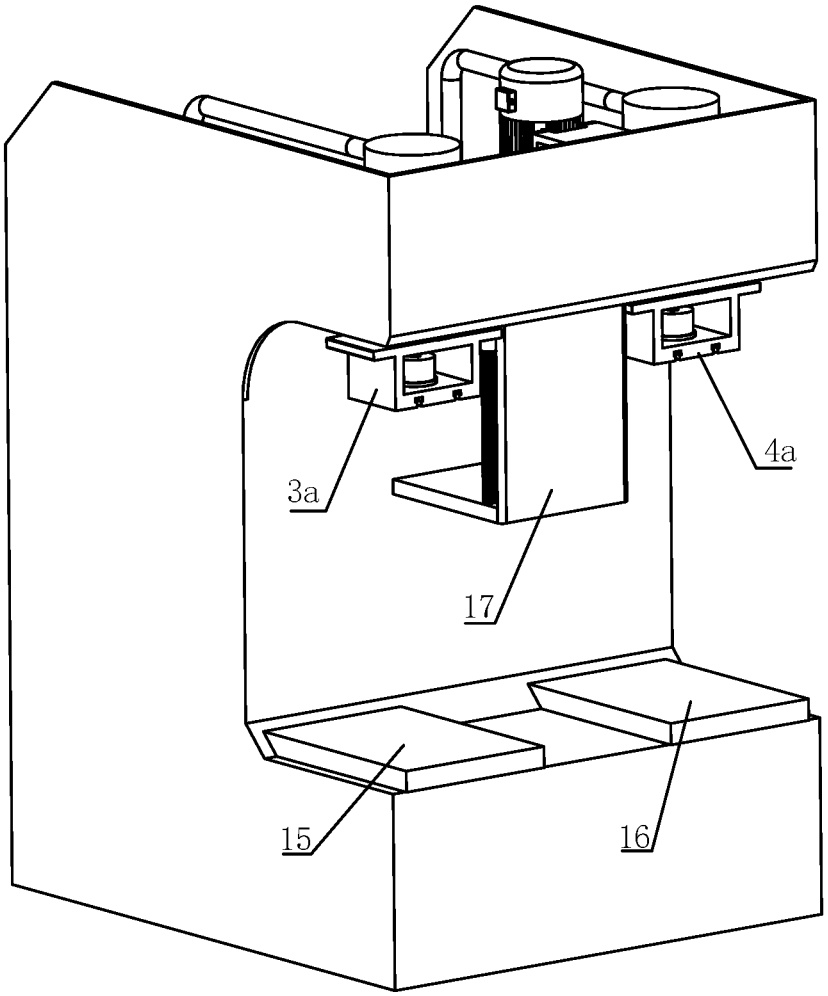
FIG. 2 is a schematic diagram showing the internal structure of the electrohydraulic hybrid press machine according to embodiment 1.
Figure 2A:
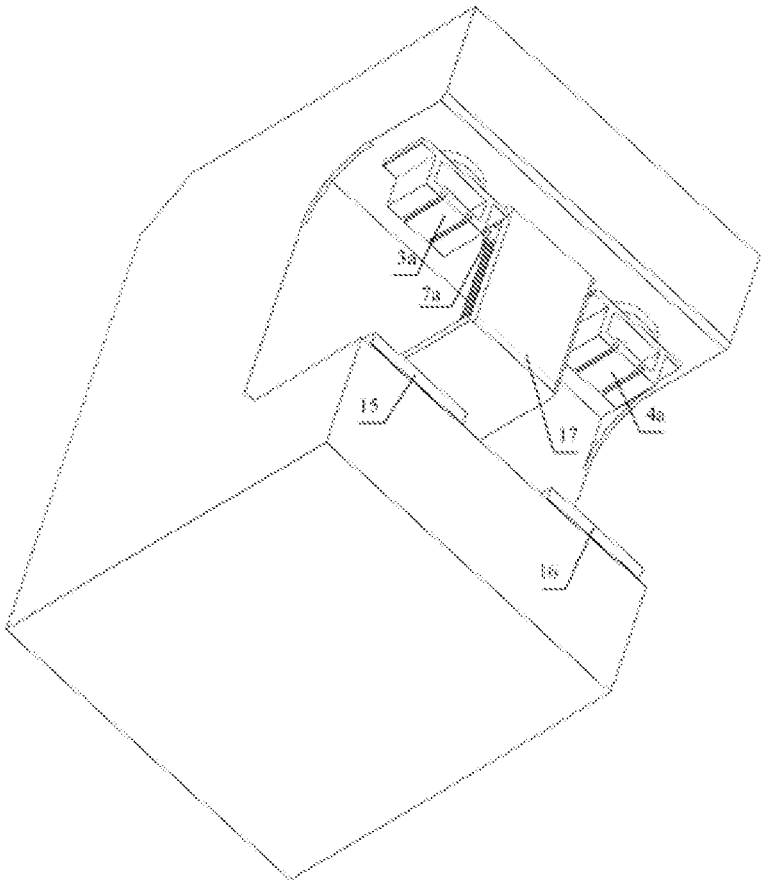
FIG. 2*a* is another schematic diagram showing the internal structure of the electrohydraulic hybrid press machine according to embodiment 1.
Figure 2B:
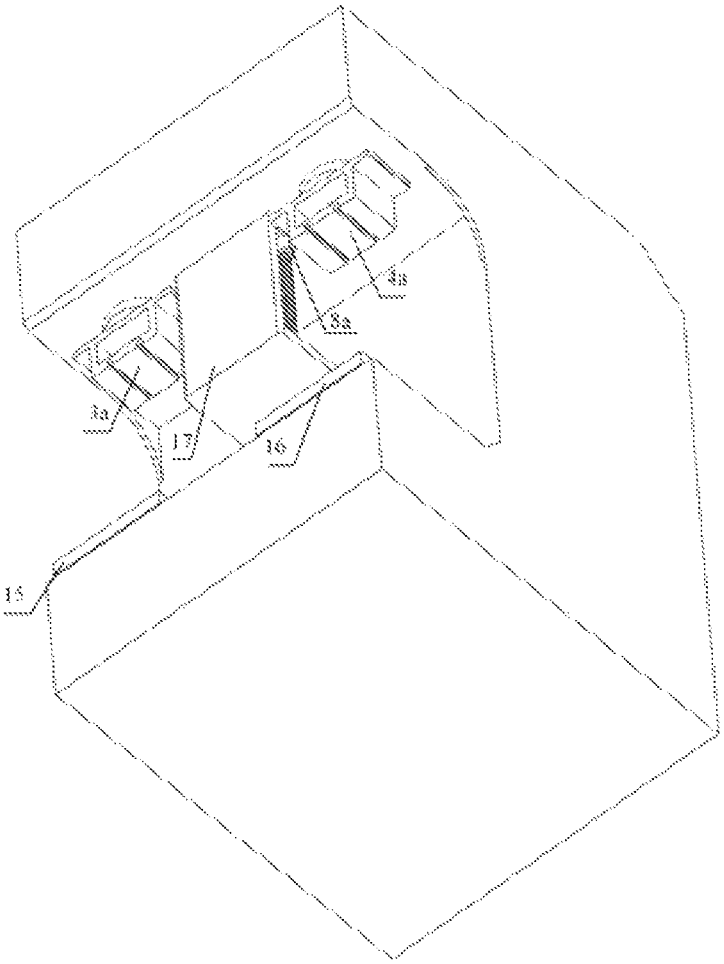
FIG. 2*b* is another schematic diagram showing the internal structure of the electrohydraulic hybrid press machine according to embodiment 1.

The labels in FIG. 1 and FIG. 2: 1, body of the electro-hydraulic hybrid press; 2, upper beam plate; 3, first hydraulic cylinder; 3*a*, moveable part of first hydraulic cylinder; 4, second hydraulic cylinder; 4*a*, moveable part of second hydraulic cylinder; 5, first meshing gear; 6, second meshing gear; 7, first lead screw; 8, second lead screw; 9, transmission gear; 10, gear shaft; 11, electromagnetic brake; 12, electromagnetic clutch; 13, driving motor; 14, support plate; 15, first workbench; 16, second workbench; 17, lead screw bracket; 18, upper chamber port of first hydraulic cylinder; 19, upper chamber port of second hydraulic cylinder; 20, lower chamber port of first hydraulic cylinder; 21, lower chamber port of second hydraulic cylinder; 22, oil tank; 23, power motor; 24, hydraulic pump; 25, tank cap; 26*a*, first oil inlet branch pipe; 26*b*, second oil inlet branch pipe; 27, three-position four-way electromagnetic directional valve; 28, oil inlet of the main pipe; 29, overflow valve; 30, oil returning main pipe.

Figure 3:
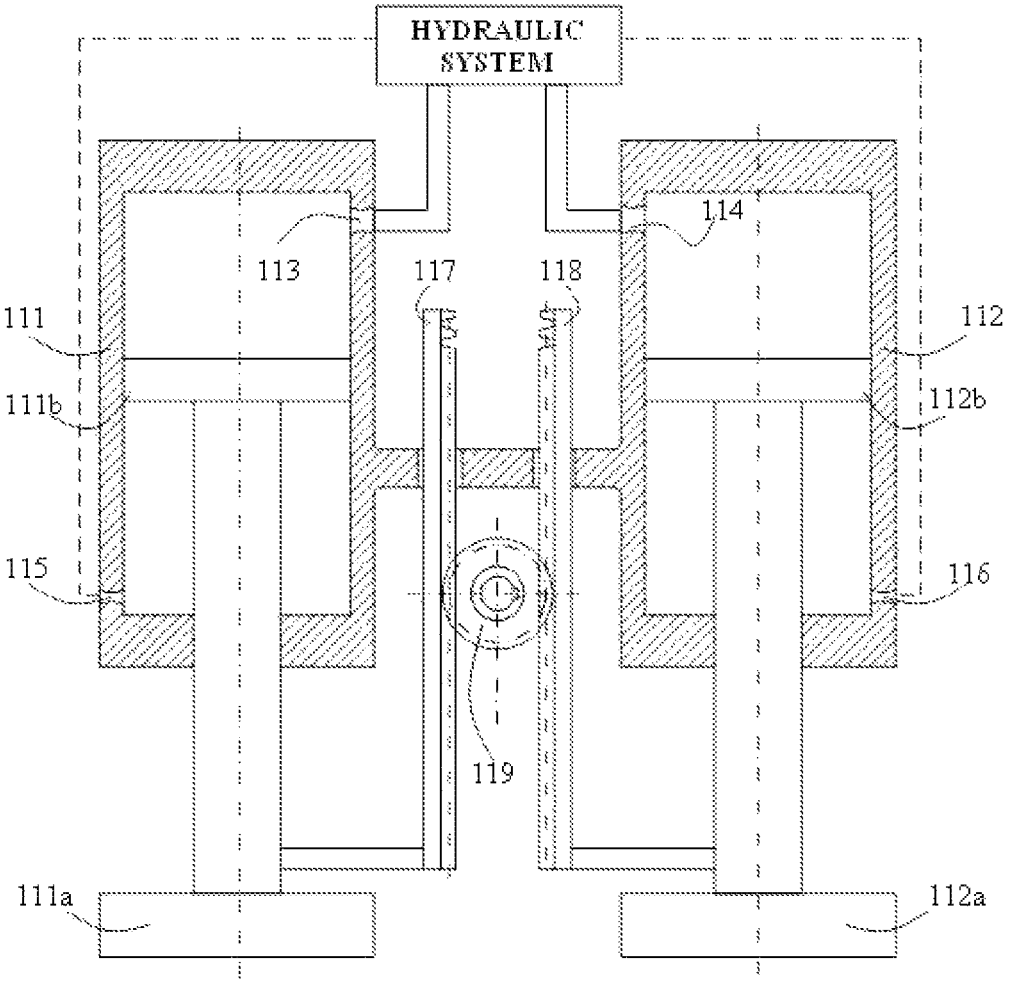
FIG. 3 is a schematic diagram of an execution system according to embodiment 2.
Figure 4:
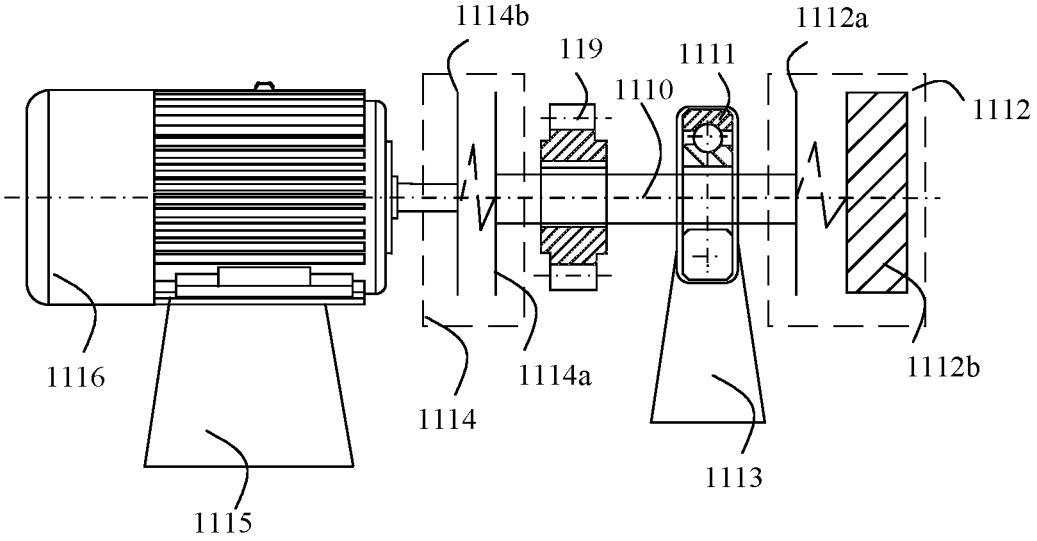
FIG. 4 is a schematic structural diagram of a mechanical synchronization and a mechanical mechanism according to embodiment 2.

The labels in FIG. 3 and FIG. 4: 111, first hydraulic cylinder; 111*a*, moveable part first hydraulic cylinder; 111*b*, first hydraulic cylinder piston; 112, second hydraulic cylinder; 112*a*, moveable part of second hydraulic cylinder; 112*b*, second hydraulic cylinder piston; 113, upper chamber port of first hydraulic cylinder; 114, upper chamber port of second hydraulic cylinder; 115, lower chamber port of first hydraulic cylinder; 116, lower chamber port of second hydraulic cylinder; 117, first rack; 118, second rack; 119, sun gear; 1110, gear shaft; 1111, bearing; 1112, electromagnetic brake; 1112*a*, first end surface of electromagnetic brake; 1112*b*, second end surface of electromagnetic brake; 1113, bearing support bracket; 1114, electromagnetic clutch; 1114*a*, first end surface of electromagnetic clutch; 1114*b*, second end surface of electromagnetic clutch; 1115, electric motor bracket; 1116, electric motor.

DETAILED DESCRIPTION OF THE EMBODIMENTS

Embodiment 1

In the present embodiment, in the electro-hydraulic hybrid press machine, two vertical hydraulic cylinders are arranged into one press body, and the two hydraulic cylinders correspond one-to-one correspondence to workbenches at corresponding positions, constituting left and right working units; a common mechanical drive unit and a common hydraulic drive unit are set for the left and right working units; the mechanical drive unit and moveable parts of two hydraulic cylinders form a linkage structure outside the cylinder body through a mechanical transmission structure, and the two hydraulic cylinders are electrically driven and reversely linked using the mechanical drive unit.

Referring to FIG. 1, FIG. 2, FIG. 2*a* and FIG. 2*b*, the structure of the electro-hydraulic hybrid press machine in this embodiment is presented as follow.

The two hydraulic cylinders are a first hydraulic cylinder 3 and a second hydraulic cylinder 4 respectively, and are arranged symmetrically on an upper beam plate 2 of a press machine body 1, a first workbench 15 and a second workbench 16 are arranged in a one-to-one correspondence directly under the first hydraulic cylinder 3 and the second hydraulic cylinder 4, the first hydraulic cylinder 3 and the first workbench 15 constitute the left working unit, and the second hydraulic cylinder 4 and the second workbench 16 constitute the right working unit; the mechanical drive unit and the hydraulic drive unit shared by the left working unit and the right working unit are set, the first hydraulic cylinder 3 and the second hydraulic cylinder 4 are hydraulic piston cylinders or hydraulic plunger type cylinders, and the effective area of the piston or the plunger in the upper chamber of the first hydraulic cylinder 3 and the second hydraulic cylinder 4 can be the same or different.

The mechanical drive unit has a structural form as follows: the power is provided by the driving motor 13, the electromagnetic clutch 12 is arranged on the output shaft of the driving motor 13, the electromagnetic clutch 12 is connected to the gear shaft 10, the transmission gear 9 is installed on the gear shaft 10, the electromagnetic brake 11 is arranged between the electromagnetic clutch 12 and the transmission gear 9, the first meshing gear 5 and the second meshing gear 6 are respectively installed on the left and right sides of the transmission gear 9, the gear shafts of the first meshing gear 5 and the meshing gears 6 are arranged in a one-to-one correspondence with a first lead screw 7 and a second lead screw 8 which are arranged vertically, and a first nut seat 7*a* and a second nut seat 8*a* constitute lead screw-nut pairs respectively with the first lead screw 7 and the second lead screw 8 in a one-to-one correspondence, and the first nut seat 7*a* and the second nut seat 8*a* move reversely in a vertical direction by rotating the transmission gear 9; the first nut seat 7*a* and the second nut seat 8*a* constitute linkage structures outside the cylinder body respectively with the moveable part of the first hydraulic cylinder 3 and the second hydraulic cylinder 4 in a one-to-one correspondence; the mechanical drive unit is installed on the upper beam plate 2 by a support plate 14, and a lead screw bracket 17 is provided at the bottom of the upper beam plate 2 for supporting the first lead screw 7 and the second lead screw 8. In this structural form, the axes of the first hydraulic cylinder 3 and the second hydraulic cylinder 4, the transmission gear 9, the first meshing gear 5, and the second meshing gear 6 are in the same vertical plane.

In a specific implementation, the transmission gear 9, the first meshing gear 5 and the second meshing gear 6 may also be arranged to be sequentially engaged, that is, the transmission gear 9 engages with the first meshing gear 5 and the first meshing gear 5 engages with the second meshing gear 6, and the rotation directions of the first lead screw 7 and the second lead screw 8 are appropriately set to ensure that the first nut seat 7*a* and the second nut seat 8*a* reversely move in a vertical direction when the transmission gear 9 rotates. In this structural form, the axis of the transmission gear 9 is not in the plane defined by the axes of the first hydraulic cylinder 3 and the second hydraulic cylinder 4.

The hydraulic drive unit has a structural form as follows: a hydraulic pump 24 is driven by a power motor 23 installed on the oil tank cap 25, an oil outlet of the hydraulic pump 24 is connected to a three-position four-way electromagnetic directional valve 27 through an oil inlet of the main pipe 28, the port A and the port B of the three-position four-way electromagnetic directional valve 27 are connected to the upper chamber port 18 of the first hydraulic cylinder and an upper chamber port 19 of the second hydraulic cylinder through a first oil inlet branch pipe 26*a* and the second oil inlet branch pipe 26*b* in a one-to-one correspondence, the port T of the three-position four-way electromagnetic directional valve 27 is connected to an oil tank 22 though an oil returning main pipe 30, a lower chamber port 20 of the first hydraulic cylinder and a lower chamber port 21 of the second hydraulic cylinder are connected to the oil tank 22 through the oil returning main pipe 30 respectively, a branch of the oil inlet of the main pipe 28 is connected to an overflow valve 29; a configuration in the middle position of the three-position four-way electromagnetic directional valve 27 is H-type, where the port P, the port A, the port T, and the port B are all communicated; at a left position, the port P communicates with the port A, and the port T communicates with the port B; and at the right position, the port P communicates with the port B, and the port T communicates with the port A. If the first hydraulic cylinder 3 or the second hydraulic cylinder 4 is a plunger type cylinder, the hydraulic cylinder has no lower chamber port, and thus the oil returning main pipe 30 does not need to be connected to the plunger type cylinder. A hydraulic valve group is composed of the three-position four-way electromagnetic directional valve 27 and the overflow valve 29 can be hydraulic valve groups capable of achieving the same function respectively.

Press machine initialization: the press machine is powered off, the electromagnetic brake 11 is braked to the gear shaft 10 due to the loss of power, and the power of electromagnetic clutch 12 is cut off to disconnect the output shaft of the driving motor 13 from the gear shaft 10. According to requirements of the process, the vertical positions of the moveable part 3*a* of the first hydraulic cylinder and the movable part 4*a* of the second hydraulic cylinder are manually adjusted such that the moveable part 3*a* of the first hydraulic cylinder and the moveable part 4*a* of the second hydraulic cylinder are both at their respective initial positions, so that the press machine is in an initial state According to the initial state of the press machine, the control process is shown as follows:

Step 1, synchronously performing fast falling of the left working unit and fast rising of the right working unit.

The motor 23 is started to drive the hydraulic system, the three-position four-way electromagnetic directional valve 27 is set at a middle position to realize that the hydraulic system is unloaded. The output shaft of the driving motor 13 is set to rotate counterclockwise, the electromagnetic brake 11 is released from braking, and the electromagnetic clutch 12 is turned on. The transmission gear 9 is driven by the driving motor 13. A transmission of a meshing and the lead screw-nut pair, the moveable part 3*a* of the first hydraulic cylinder 3 moves rapidly downward with the drive of the first nut seat 7*a*. At the same time, the moveable part 4*a* of the second hydraulic cylinder 4 moves rapidly upward with the drive of the second nut seat 8*a*. So that the synchronization of fast falling of the left working unit and fast rising of the right working unit is realized.

Step 2, synchronously performing working process of the left work unit and slow rising of the right work unit.

When fast falling of the left working unit is completed, the three-position four-way electromagnetic directional valve 27 is set at the left position, and then a high-pressure hydraulic oil is supplied to the upper chamber port 18 of the first hydraulic cylinder through a first oil inlet pipe 26*a*. Both of the mechanical drive unit and the hydraulic drive unit jointly complete working process of the left work unit and slow rising of the right work unit by controlling the rotational speed of the driving motor 13.

Step 3, pressure maintaining of the left working unit.

When working process of the left working unit is completed, the electromagnetic clutch 12 is disconnected, and the driving motor 13 is controlled to achieve clockwise idling, so that the driving motor 13 reaches a stable rotational speed. The pressure maintaining of the left working unit is completed by the hydraulic drive unit. The hydraulic oil leaking from the piston of the first hydraulic cylinder 3 flows back to the oil tank 22 through the oil port of the lower chamber of the first hydraulic cylinder 20.

Step 4, synchronously performing fast falling of the right working unit and fast rising of the left working unit.

When pressure maintaining of the left working unit is completed, the three-position four-way electromagnetic directional valve 27 is controlled to switch to the middle position, the hydraulic system is unloaded, and the electromagnetic clutch 12 is turned on. Meanwhile, the driving motor 13 drives the transmission gear 9 to rotate clockwise. The moveable part 4*a* of the second hydraulic cylinder 4 is driven by the lead screw-nut pair to realize rapid falling. The moveable part 3*a* of the first hydraulic cylinder 3 is driven by the first nut seat 7*a* to rise rapidly. So that synchronization of fast falling of the right working unit and fast rising of the left working unit is realized.

Step 5, synchronously performing working process of the right work unit and slow rising of the left work unit.

When fast falling of the right working unit is completed, the three-position four-way electromagnetic directional valve 27 is controlled to switch to the right position, and the high-pressure hydraulic oil is supplied to the upper chamber port 19 of the second hydraulic cylinder through a second oil inlet pipe 26*b* so as to control the rotational speed of the driving motor 13, the mechanical drive unit and the hydraulic drive unit jointly complete working process of the right work unit, and slow rising of the left work unit is synchronously realized.

Step 6, pressure maintaining of the right working unit.

When working process of the right working unit is completed, the electromagnetic clutch 12 is disconnected, and the driving motor 13 is controlled to achieve counterclockwise idling. So that the driving motor 13 reaches a stable rotational speed when pressure maintaining of the right working unit is completed. The pressure maintaining of the right working unit is only completed by the hydraulic drive unit. The hydraulic oil leaking from the piston of the first hydraulic cylinder 4 flows back to the oil tank 22 through the lower chamber port of the first hydraulic cylinder 21.

In this embodiment, the control method of the electro-hydraulic hybrid press is shown as follows:

When the moveable part 3*a* of the first hydraulic cylinder 3 falls to the set position, the upper chamber port 18 the first hydraulic cylinder is cut off, the electromagnetic clutch 12 is turned off, the electromagnetic brake 11 is controlled to brake the transmission gear 9. The moveable part 3*a* of the first hydraulic cylinder 3 is braked at the set position by the first nut seat 7*a*. At the same time, the moveable part 4*a* of the second hydraulic cylinder 4 is also braked at the corresponding position.

When the moveable part 4*a* of the second hydraulic cylinder 4 falls to the set position, the upper chamber port 19 of the second hydraulic cylinder is cut off, the electromagnetic clutch 12 is turned off, and the electromagnetic brake 11 is controlled to brake the transmission gear 9. The moveable part 4*a* of the second hydraulic cylinder 4 is braked at the set position. At the same time, the moveable part 3*a* of the first hydraulic cylinder 3 is also braked at the corresponding position.

Embodiment 2

In this embodiment, as for the mechanical-hydraulic hybrid double-station press machine execution system, two vertical hydraulic cylinders are arranged in one press machine body, and the two hydraulic cylinders correspond one-to-one correspondence to workbenches at corresponding positions, constituting left and right working units; a common mechanical drive unit and a common hydraulic drive unit are set for the left and right working units; the mechanical drive unit and moveable parts of two hydraulic cylinders form a linkage structure outside a cylinder body through a mechanical transmission structure. Using the mechanical drive unit, the two hydraulic cylinders are electrically driven and reversely linked.

Referring to FIG. 3 and FIG. 4, first hydraulic cylinder 111 and a second hydraulic cylinder 112 respectively, which are symmetrically fixed to the press machine body in a left-right direction and are in the same vertical plane, at a position between the first hydraulic cylinder 111 and the second hydraulic cylinder 112, a gear rack transmission mechanism driven by the electric motor 1116 through the electromagnetic clutch 1114 and the electromagnetic brake 1112 are provided; the gear rack transmission mechanism has a sun gear 119 and a first rack 117 and a second rack 118 which are respectively arranged on the right and left sides of the sun gear and meshed with the sun gear 119, and the first rack 117 and the second rack 118 move synchronously in vertical and reverse direction by rotating the sun gear 119, the first rack 117 and a moveable part 111*a* outside a body of the first hydraulic cylinder 111 constitute a linkage structure through a first link rod, the second rack 118 and a moveable part 112*a* outside of a body of the second hydraulic cylinder 112 constitute a linkage structure through a second link rod, thereby forming the mechanical drive unit.

As shown in FIG. 3 and FIG. 4, in the gear rack transmission mechanism, the gear shaft 1110 passes through the inner ring of the bearing 1111 and is fixed thereto, the outer ring of the bearing 1111 is fixed to the press body using the bearing support bracket 1113. So that the gear shaft 1110 is supported by the bearing 1111, the bracket 1113 is supported by the bearing 1111. The electric motor 1116 and the electromagnetic brake 1112 are respectively installed at the two ends of the gear shaft 1110. The rotation of the gear shaft 1110 is driven by the motor 1116, the gear shaft 1110 is braked by the electromagnetic brake 1112, the electromagnetic clutch 1114 is installed on the gear shaft 1110 between the electric motor 1116 and the sun gear 119. One end of the gear shaft 1110 shown in FIG. 4 is coaxially fixed with the first end surface 1114*a* of the electromagnetic clutch, the second end surface 1114*b* of the electromagnetic clutch is coaxially fixed with the output shaft of the electric motor 1116, the electric motor 1116 is fixed to the press machine body by the electric motor bracket 1115. The other end of the gear shaft 1110 is coaxially fixed with first end surface 1112*a* of the electromagnetic brake, the second end surface 1112*b* of the electromagnetic brake is fixed to the press machine body.

In a specific implementation, either of the first hydraulic cylinder and the second hydraulic cylinder can be a piston cylinder, a hydraulic plunger type cylinder, or the combination of a hydraulic piston cylinder and a hydraulic plunger type cylinder. When the combination of the hydraulic piston cylinder and the hydraulic plunger type cylinder is used, the moveable part is a unitary structure.

The control method of the mechanical-hydraulic hybrid double-station press includes fast falling, pressing, and braking.

Fast falling is implemented as follows.

For the first hydraulic cylinder 111, the first end surface 1112*a* of the electromagnetic brake is separated from the second end surface 1112*b* of the electromagnetic brake. The control electromagnetic clutch 1114 is turned on, and the first end surface 1114*a* of the electromagnetic clutch connects to the second end surface 1114*b* of the electromagnetic clutch. The electric motor 1116 is controlled to rotate counterclockwise, the first rack 117 moves vertically downward to move the moveable part 111*a* of the first hydraulic cylinder 111 downward. The first hydraulic cylinder piston 111*b* moves downward, the low-pressure oil in the hydraulic system is controlled to enter the upper chamber of the first hydraulic cylinder 111 from the upper chamber port 113 of the first hydraulic cylinder. Thereby, fast falling of the first hydraulic cylinder 111 is achieved. Meanwhile, the second rack 118 moves vertically upward to move the moveable part 112*a* of the second hydraulic cylinder upward, then the second hydraulic cylinder piston 112*b* moves upward, the hydraulic oil in the upper chamber of the second hydraulic cylinder 112 enters the hydraulic system from the upper chamber port 114 of the second hydraulic cylinder. Thereby, fast rising of the second hydraulic cylinder 112 is achieved.

For the second hydraulic cylinder 112, the electromagnetic brake 1112 is turned off, the electromagnetic clutch 1114 is turned on, the electric motor 1116 is controlled to rotate clockwise, and the second rack 118 moves vertically downward to drive the moveable part 112*a* of the second hydraulic cylinder, the low-pressure oil in the hydraulic system is controlled to enter the upper chamber of the second hydraulic cylinder 112 from the upper chamber port 114 of the second hydraulic cylinder. Thereby, fast falling of the second hydraulic cylinder 112 is achieved. Meanwhile, the first rack 117 moves vertically upward to move a moveable part 111*a* of the first hydraulic cylinder upward, and the hydraulic oil in the upper chamber of the first hydraulic cylinder 111 enters the hydraulic system from the upper chamber port 113 of the first hydraulic cylinder. Thereby, fast rising of the first hydraulic cylinder 111 is achieved.

The pressing is implemented as follows.

For the first hydraulic cylinder 111, when fast falling of the first hydraulic cylinder 111 is completed, both the electromagnetic brake 1112 and the electromagnetic clutch 1114 are controlled to be disconnected. The high-pressure oil in the hydraulic system enters the upper chamber of the first hydraulic cylinder 111 from the upper chamber port 113 of the first hydraulic cylinder. Then the moveable part 111*a* of the first hydraulic cylinder moves downward, the high-pressure oil of the upper chamber of the first hydraulic cylinder 111 returns to the hydraulic system through the lower chamber port 115 of the first hydraulic cylinder. Thereby, the pressing of the first hydraulic cylinder 111 is achieved. Meanwhile, the first rack 117 is driven to move downward for moving the second rack 118 upward through the gear 119. So that the moveable part 112*a* of the second hydraulic cylinder moves upward by the moving of the second rack 118. The hydraulic oil in the upper chamber of the second hydraulic cylinder 112 enters the hydraulic system from the upper chamber port 114 of the second hydraulic cylinder. Thereby, slow rising of the second hydraulic cylinder 112 is achieved.

For the second hydraulic cylinder 112, when fast falling of the second hydraulic cylinder 112 is completed, both the electromagnetic brake 1112 and the electromagnetic clutch 1114 are controlled to be disconnected. The high-pressure oil in the hydraulic system enters the upper chamber of the second hydraulic cylinder 112 from upper chamber port 114 of the second hydraulic cylinder, the moveable part 112*a* of the second hydraulic cylinder moves downward, and the high-pressure oil of the upper chamber of the second hydraulic cylinder 112 returns to the hydraulic system through the lower chamber port 116 of the second hydraulic cylinder. Thereby, the pressing of the second hydraulic cylinder 112 is achieved. Meanwhile, the second rack 118 moves downward, and the first rack 117 moves upward by the gear 119. So that the moveable part 111*a* of the first hydraulic cylinder moves upward by moving the first rack 117. The hydraulic oil in the upper chamber of the first hydraulic cylinder 111 enters the hydraulic system from the upper chamber port 113 of the first hydraulic cylinder. Thereby, slow rising of the first hydraulic cylinder 111 is achieved.

Moreover, the electromagnetic clutch 1114 can also be set to the ON state to realize that the hydraulic system and the mechanical system simultaneously provide energy for the pressing in practice.

The braking process is implemented as follows.

For the first hydraulic cylinder 111, when the moveable part 111*a* of the first hydraulic cylinder falls to the set position, the oil inlet in the upper chamber 113 of the first hydraulic cylinder is shut off. Then the electromagnetic brake 1112 is set in the braking state. So that the sun gear 119 is braked by the electromagnetic brake 1112. The moveable part 111*a* of the first hydraulic cylinder is braked at the set position by the first rack 117. Meanwhile, the moveable part 112*a* of the second hydraulic cylinder is braked at a corresponding position by the second rack 118.

For the second hydraulic cylinder 112, when the moveable part of the second hydraulic cylinder 112 falls to the set position, the oil inlet in the upper chamber 114 of the second hydraulic cylinder is shut off. The electromagnetic brake 1112 is set in the braking state. So that the sun gear 119 is braked by the electromagnetic brake 1112, the moveable part 112*a* of the second hydraulic cylinder is braked at the set position by the second rack 118. Meanwhile, the moveable part 111*a* of the first hydraulic cylinder is braked at a corresponding position by the first rack 117.

In the embodiment 2, by setting a double-station hydraulic cylinder and keeping synchronous motion, the two working processes can be carried out simultaneously. So that the time of each working process can be reduced, the working efficiency of the press machine is improved. The moveable part of the rising hydraulic cylinder can be directly driven by the moveable part of the falling hydraulic cylinder for avoiding the potential energy losses of the moveable parts.

In the embodiment 2, by using mechanical synchronization devices such as gears and racks between the two synchronous hydraulic cylinders, the number of the used hydraulic pipes is reduced. So, the losses of hydraulic pipes can be reduced. When the piston areas of the two hydraulic cylinders are different, they still can have the same moving speed to realize the double-station working process under different pressure and improve the application range of the actuators of the double-station press machine.

In the embodiment 2, by setting up the electro-hydraulic hybrid drive mode and selecting the corresponding drive unit according to the working requirements, a high-efficiency operation of the drive units and a lower energy consumption during the operation process are realized.

In the embodiment 2, the mechanical brake device of electromagnetic brake is set between two synchronous hydraulic cylinders, which ensures the precise stop of the moveable part of the hydraulic cylinder and improves the positioning accuracy of the press machine.

What is claimed is:

1. An electro-hydraulic hybrid press machine comprising two hydraulic cylinders arranged vertically in a press machine body, and the two hydraulic cylinders correspond to workbenches at corresponding positions in a one-to-one correspondence, constituting left and right working units; a common mechanical drive unit and a common hydraulic drive unit are set for the left and right working units; the mechanical drive unit and moveable parts of two hydraulic cylinders form a linkage structure outside a cylinder body through a mechanical transmission structure, and using the mechanical drive unit, the two hydraulic cylinders are electrically driven and move reversely, wherein the two hydraulic cylinders are a first hydraulic cylinder (3) and a second hydraulic cylinder (4) respectively, and are arranged symmetrically on an upper beam plate (2) of the press machine body (1) in a left-right direction, a first workbench (15) and a second workbench (16) are arranged in a one-to-one correspondence directly under the first hydraulic cylinder (3) and the second hydraulic cylinder (4), the first hydraulic cylinder (3) and the first workbench (15) constitute the left working unit, and the second hydraulic cylinder (4) and the second workbench (16) constitute the right working unit;

wherein the mechanical drive unit comprises: a driving motor (13) is provided as a power, an electromagnetic clutch (12) is arranged on an output shaft of the driving motor (13), the electromagnetic clutch (12) is connected to a gear shaft (10), and a transmission gear (9) is arranged on the gear shaft (10), and an electromagnetic brake (11) is arranged between the electromagnetic clutch (12) and the transmission gear (9), meshing gears are symmetrically arranged on left and right sides of the transmission gear (9), gear shafts of the two meshing gears are arranged in a one-to-one correspondence as a first lead screw (7) and a second lead screw (8) which are arranged vertically, and a first nut seat and a second nut seat constitute lead screw-nut pairs respectively with the first lead screw (7) and the second lead screw (8) in a one-to-one correspondence, the first nut seat and the second nut seat move reversely in a vertical direction by rotating the transmission gear (9), the first nut seat and the second nut seat constitute linkage structures outside the cylinder body respectively with a moveable part of the first hydraulic cylinder (3) and a moveable part of the second hydraulic cylinder (4) in a one-to-one correspondence;

wherein the hydraulic drive unit comprises: a hydraulic pump (24) is driven by a power motor (23), an oil outlet of the hydraulic pump (24) is connected to a port P of a three-position four-way electromagnetic directional valve (27) through an oil inlet of a main pipe (28), a port A and a port B of the three-position four-way electromagnetic directional valve (27) are connected to an upper chamber port (18) of the first hydraulic cylinder and an upper chamber port (19) of the second hydraulic cylinder respectively through a first oil inlet branch pipe (26*a*) and a second oil inlet branch pipe (26*b*) in a one-to-one correspondence, a port T of the three-position four-way electromagnetic directional valve (27) is connected to an oil tank (22) though an oil returning main pipe (30), a lower chamber port (20) of the first hydraulic cylinder and a lower chamber port (21) of the second hydraulic cylinder are connected to the oil tank (22) through the oil returning main pipe (30), an overflow valve (29) through a branch of the oil inlet of the main pipe (28) respectively; and in the three-position four-way electromagnetic directional valve (27), a configuration in a middle position is H-type, wherein the port P, the port A, the port T, and the port B thereof are all communicated; at a left position, the port P communicates with the port A and the port T communicates with the port B; and at a right position, the port P communicates with the port B and the port T communicates with the port A.

2. A control method for a electro-hydraulic hybrid press machine comprising: two hydraulic cylinders arranged vertically in a press machine body, and the two hydraulic cylinders correspond to workbenches at corresponding positions in a one-to-one correspondence, constituting left and right working units; a common mechanical drive unit and a common hydraulic drive unit are set for the left and right working units; the mechanical drive unit and moveable parts of two hydraulic cylinders form a linkage structure outside a cylinder body through a mechanical transmission structure, and using the mechanical drive unit, the two hydraulic cylinders are electrically driven and move reversely, wherein the two hydraulic cylinders are a first hydraulic cylinder (3) and a second hydraulic cylinder (4) respectively, and are arranged symmetrically on an upper beam plate (2) of the press machine body (1) in a left-right direction, a first workbench (15) and a second workbench (16) are arranged in a one-to-one correspondence directly under the first hydraulic cylinder (3) and the second hydraulic cylinder (4), the first hydraulic cylinder (3) and the first workbench (15) constitute the left working unit, and the second hydraulic cylinder (4) and the second workbench (16) constitute the right working unit;

wherein the mechanical drive unit comprises: a driving motor (13) is provided as a power, an electromagnetic clutch (12) is arranged on an output shaft of the driving motor (13), the electromagnetic clutch (12) is connected to a gear shaft (10), and a transmission gear (9) is arranged on the gear shaft (10), and an electromagnetic brake (11) is arranged between the electromagnetic clutch (12) and the transmission gear (9), meshing gears are symmetrically arranged on left and right sides of the transmission gear (9), gear shafts of the two meshing gears are arranged in a one-to-one correspondence as a first lead screw (7) and a second lead screw (8) which are arranged vertically, and a first nut seat and a second nut seat constitute lead screw-nut pairs respectively with the first lead screw (7) and the second lead screw (8) in a one-to-one correspondence, the first nut seat and the second nut seat move reversely in a vertical direction by rotating the transmission gear (9), the first nut seat and the second nut seat constitute linkage structures outside the cylinder body respectively with a moveable part of the first hydraulic cylinder (3) and a moveable part of the second hydraulic cylinder (4) in a one-to-one correspondence;

wherein the hydraulic drive unit comprises: a hydraulic pump (24) is driven by a power motor (23), an oil outlet of the hydraulic pump (24) is connected to a port P of a three-position four-way electromagnetic directional valve (27) through an oil inlet of a main pipe (28), a port A and a port B of the three-position four-way electromagnetic directional valve (27) are connected to an upper chamber port (18) of the first hydraulic cylinder and an upper chamber port (19) of the second hydraulic cylinder respectively through a first oil inlet branch pipe (26*a*) and a second oil inlet branch pipe (26*b*) in a one-to-one correspondence, a port T of the three-position four-way electromagnetic directional valve (27) is connected to an oil tank (22) though an oil returning main pipe (30), a lower chamber port (20) of the first hydraulic cylinder and a lower chamber port (21) of the second hydraulic cylinder are connected to the oil tank (22) through the oil returning main pipe (30), an overflow valve (29) through a branch of the oil inlet of the main pipe (28) respectively; and in the three-position four-way electromagnetic directional valve (27), a configuration in a middle position is H-type, wherein the port P, the port A, the port T, and the port B thereof are all communicated; at a left position, the port P communicates with the port A and the port T communicates with the port B; and at a right position, the port P communicates with the port B and the port T communicates with the port A, the control method comprising:

step 1, synchronously performing fast falling of the left working unit and fast rising of the right working unit, wherein the power motor (23) is started to operate a hydraulic system, the three-position four-way electromagnetic directional valve (27) is set at the middle position, the hydraulic system is unloaded, the output shaft of the driving motor (13) is set to rotate counterclockwise, the electromagnetic brake (11) is released from braking, and the electromagnetic clutch (12) is turned on, the transmission gear (9) rotates counterclockwise driven by the driving motor (13), and through a transmission of the meshing gear and the lead screw-nut pair, the moveable part (3*a*) of the first hydraulic cylinder (3) falls rapidly driven by the first nut seat, and the moveable part (4*a*) of the second hydraulic cylinder (4) rises rapidly driven by the second nut seat at the same time, which realizes synchronization of fast falling of the left working unit and fast rising of the right working unit;

step 2, synchronously performing working process of the left work unit and slow rising of the right work unit, wherein when fast falling of the left working unit is completed, the three-position four-way electromagnetic directional valve (27) is switched to the left position, and a high-pressure hydraulic oil is supplied to the upper chamber port (18) of the first hydraulic cylinder through the first oil inlet branch pipe (26*a*), so as to control the rotational speed of the driving motor (13), the mechanical drive unit and the hydraulic drive unit jointly complete working process of the left working unit, and slow rising of the right work unit is synchronously realized;

step 3, pressure maintaining of the left working unit, wherein when working process of the left working unit is completed, the electromagnetic clutch (12) is disconnected, and the driving motor (13) is controlled to idling clockwise, so that the driving motor (13) reaches a stable rotational speed when a pressure maintaining of the left working unit is completed, the pressure maintaining of the left working unit is completed by the hydraulic drive unit, the hydraulic oil leaking through a piston of the first hydraulic cylinder (3) flows back to the oil tank (22) through the lower chamber port (20) of the first hydraulic cylinder;

step 4, synchronously performing fast falling of the right working unit and fast rising of the left working unit, wherein when pressure maintaining of the left working unit is completed, the three-position four-way electromagnetic directional valve (27) is switched to the middle position, the hydraulic system is unloaded, the electromagnetic clutch (12) is turned on, and the driving motor (13) drives the transmission gear (9) to rotate clockwise, and through the transmission of the meshing gear and the lead screw-nut pair, the second nut seat drives the moveable part (4*a*) of the second hydraulic cylinder (4) to fall rapidly, and the first nut seat drives the moveable part (3*a*) of the first hydraulic cylinder (3) to rise rapidly, which realizes synchronization of fast falling of the right working unit and fast rising of the left working unit;

step 5, synchronously performing working process of the right work unit and slow rising of the left work unit, wherein when fast falling of the right working unit is completed, the three-position four-way electromagnetic directional valve (27) is switched to the right position, and the high-pressure hydraulic oil is supplied to the upper chamber port (19) of the second hydraulic cylinder through the second oil inlet pipe (26*b*) so as to control the rotational speed of the driving motor (13), the mechanical drive unit and the hydraulic drive unit jointly complete working process of the right work unit, and slow rising of the left work unit is synchronously realized;

step 6, pressure maintaining of the right working unit, wherein when working process of the right working unit is completed, the electromagnetic clutch (12) is disconnected, and the driving motor (13) is counterclockwise idling, so that the driving motor (13) reaches a stable rotational speed when pressure maintaining of the right working unit is completed by the hydraulic drive unit, the hydraulic oil leaking through a piston of the second hydraulic cylinder (4) flows back to the oil tank (22) through the lower chamber port (21) of the second hydraulic cylinder.

3. The control method for the electro-hydraulic hybrid press machine according to claim 2, wherein a braking process is implemented as follows:

when the moveable part (3*a*) of the first hydraulic cylinder (3) falls to a set position, the upper chamber port (18) of the first hydraulic cylinder is cut off, the electromagnetic clutch (12) is turned off, and the transmission gear (9) is braked by the electromagnetic brake (11), and through the meshing gear and the lead screw-nut pair, the moveable part (3*a*) of the first hydraulic cylinder (3) is braked at the set position by the first nut seat, and the moveable part (4*a*) of the second hydraulic cylinder (4) is also braked at the corresponding position simultaneously;

when the moveable part (4*a*) of the second hydraulic cylinder (4) falls to a set position, the upper chamber port (19) of the second hydraulic cylinder is cut off, the electromagnetic clutch (12) is turned off, and the transmission gear (9) is braked by the electromagnetic brake (11), and through the meshing gear and the lead screw-nut pair, the moveable part (4*a*) of the second hydraulic cylinder (4) is braked at the set position by the second nut seat, and the moveable part (3*a*) of the first hydraulic cylinder (3) is also braked at the corresponding position simultaneously.

* * * * *